United States Patent [19]

Mann

[11] 3,963,236

[45] June 15, 1976

[54] GOLF CLUB SET AND METHOD OF MAKING

[76] Inventor: Robert S. Mann, P.O. Box 2615, Ormond Beach, Fla. 32074

[22] Filed: Aug. 24, 1970

[21] Appl. No.: 66,186

[52] U.S. Cl. ..... 273/77 A; 223/80 B; 29/428; 29/557

[51] Int. Cl.[2] ..... A63B 53/00

[58] Field of Search ..... 273/77 R, 77 A, 80 R, 273/80 B, 167 R, 167 G, 169, 171, 167 F; 29/428, 557, 558

[56] References Cited

UNITED STATES PATENTS

| | | | |
|---|---|---|---|
| 976,267 | 11/1910 | Knight | 273/80 B |
| 1,516,786 | 11/1924 | Prentiss | 273/77 A |
| 1,594,801 | 8/1926 | Stackpole | 273/77 A |
| 1,642,462 | 9/1927 | Reach | 273/77 A |
| 1,670,531 | 5/1928 | Cowdery | 273/80 B |
| 1,961,969 | 6/1934 | Heddon | 273/80 B |
| 1,974,271 | 9/1934 | Hackett | 273/80 B |
| 1,974,389 | 9/1934 | Cowdery | 273/80 B |
| 2,095,563 | 10/1937 | Cowdery | 273/80 B |
| 2,250,428 | 7/1941 | Vickery | 273/80 B |
| 2,447,967 | 8/1948 | Stone | 273/77 A |
| 2,457,177 | 12/1948 | Reach | 273/80 B |
| 2,822,174 | 2/1958 | Brandon | 273/77 A |
| 3,266,805 | 8/1966 | Bulla | 273/77 A |
| 3,455,558 | 7/1969 | Onions | 273/77 A X |
| 3,466,047 | 9/1969 | Rodia et al. | 273/171 |
| 3,473,370 | 10/1969 | Marciniak | 273/77 A |
| 3,606,327 | 9/1971 | Gorman | 273/171 X |
| 3,625,513 | 12/1971 | Ballmer | 273/77 A X |
| 3,655,188 | 4/1972 | Solheim | 273/77 A |
| 3,685,135 | 8/1972 | Letters | 273/80 B X |
| 3,871,649 | 3/1975 | Kilshaw | 273/77 A |

FOREIGN PATENTS OR APPLICATIONS

| | | | |
|---|---|---|---|
| 3,288 | 2/1913 | United Kingdom | 273/80 B |
| 256,049 | 8/1926 | United Kingdom | 273/80 B |
| 470,178 | 8/1937 | United Kingdom | 273/80 B |
| 465,414 | 5/1937 | United Kingdom | 273/80 B |

OTHER PUBLICATIONS

"Golf Digest" magazine; Sept. 1969; pp. 42–47.

"Kenneth Smith Golf Club Catalog;" 1969; pp. 5, 12 and 13.

*Primary Examiner*—Richard J. Apley

*Attorney, Agent, or Firm*—Sheridan, Ross & Fields

[57] ABSTRACT

A matched and correlated set of golf club irons is produced by preparing a series of shafts which vary substantially uniformly in flexibility and securing the most flexible shaft to the lowest numbered head in the set, securing the next less flexible shaft to the next higher numbered head, and repeating the process until all the shafts and heads are joined. The shafts are prepared by providing a first group of basic stock shafts of substantially identical stiffness characteristics and cutting off the tip ends in uniformly increasing increments to vary the flexibility. The first group of shafts is connected to heads from the lowest number to one of the middle distance irons. A second group of basic stock shafts having identical stiffness characteristics greater than the first group is similarly prepared and provided for the higher numbered heads. Each successive head is heavier than the preceding head by an increment sufficient to produce a gradual increase in swing weight from the lowest to the highest numbered iron in the set.

27 Claims, 3 Drawing Figures

GOLF CLUB SET AND METHOD OF MAKING

BACKGROUND OF THE INVENTION

This invention lies in the field of golf clubs and methods of producing coordinated sets. It is more particularly directed to the type of clubs commonly known as "irons" and to a new and different relation between the various irons in any given set.

High quality irons are made and marketed in "matched" sets which are intended to assist a golfer in achieving uniformly good playing ability with all of the clubs rather than a few favorite ones which seen best suited to him. A widely held theory is that such matching consists in providing the same feel or "swing weight" with each club. In a conventional set, such as eight clubs ranging from a long distance No. 2 to a short distance No. 9, the total length of each successive club is shorter by about one half inch than the preceding club and the head weight is progressively increased by a small amount as the length is decreased to achieve the desired constant swing weight.

While swing weight is not a concrete term there are two generally accepted ways of measuring it which produce consistent results on arbitrary scales. One system determines the static moment of a club and is disclosed in U.S. Pat. No. 1,953,916, issued to R. W. Adams. In this patent, a club is mounted on a beam scale so that the grip is supported in cantilever fashion over the beam with a fulcrum at a constant distance in from the grip end of the club, such as about 14 inches, with the head spaced away from the scale. The head consequently produces a substantial overbalance, and a poise is moved along the beam to obtain a balance. At this point, the reading on the beam, marked to an arbitrary scale, represents the swing weight of the club. These readings may for example be units denoted DO (zero), D1, D2 etc. to as high a figure as needed. If the reading for a first club is D2 and for a second club is D1, then the head weight of the second club may be increased until the swing weight is D2. The same procedure may be followed with an entire set so that they will all have the same D2 swing weight.

Another system of comparative measurement the prior art discloses, a club mounted on the table of a torsional pendulum and its moment of inertia is determined. Other clubs are mounted in the same way and measured. Similarly, the head weights may be increased, or decreased as required to obtain the same moment of inertia throughout the set. Although the prior art reference contends that the dynamic moment reading gives better results than the static moment reading because golf clubs are used in a dynamic way, it has been found that the results of both systems are close enough to achieve their intended result of fairly constant swing weight. No consideration is given by either of them to any relation of the flexibilities of the clubs in a set.

Another prior art reference discloses the idea of varying the stiffness of the shafts, using the most flexible shafts with the lowest numbered irons and the least flexible shafts with the highest numbered irons, with the flexibility varying on a logarithmic scale. He gives no consideration to any relation between the head weights or the swing weights of the clubs in a set.

It has been found that although sets having constant swing weights and sets having predetermined variations of flexibility are far more satisfactory than haphazardly arranged unmatched sets, they still leave much to be desired. Assumimg that a given golfer has found a set in which the middle distance irons seem to be well suited to his style and ability, he will find that the others do not seem to be right for his purposes. His actual trouble is that, with such a set, the lower numbered irons are too heavy and stiff for him and the higher numbered irons are too flexible and light.

SUMMARY OF THE INVENTION

The present invention overcomes the difficulties mentioned above and provides a set of irons which are properly correlated throughout for optimum performance. In addition it provides a method or process of manufacture which utilizes basic stock shafts rather than a different and separately manufactured shaft for each numbered iron, and insures accurate duplication from one set to the next.

Generally stated, the invention comprises the production of a set of successively numbered irons in which the shaft flexibility decreases in substantially uniform increments from the lowest numbered iron to the highest numbered iron in the particular set, and the swing weight increases in substantially uniform increments from the lowest numbered to the highest numbered iron in the set. The manner of carrying out the inventive concepts will be described in connection with a short set of eight irons from No. 2 to No. 9 for simplicity, although it will be understood that the same principles apply from No. 1 through the sand wedge.

Such a set may be divided into a first group from NO. 2 to No. 5, and a second group from No. 6 to No. 9. For the first group, four basic stock shafts are provided which are identical in all respects including stiffness characteristics within the usual manufacturing tolerances, the stiffness classification being "regular". These shafts as received from the manufacturer are somewhat longer than necessary so that excess material may be cut off to produce the exact total club length desired. The tip ends are rather flexible while the butt or grip ends are practically rigid by comparison. A first shaft with full tip end length is connected to a No. 2 head, the weight of which has been predetermined to produce a finished club having the desired characteristics. A second shaft is now selected and one third inch of length is cut off the tip end. The trimmed shaft is now connected to a No. 3 head which is sufficiently heavier than the No. 2 head to produce a greater swing weight in the finished No. 3 club by a certain increment. The same procedure is followed with the third and fourth shafts, cutting off two thirds inch and one inch respectively and using successively heavier heads to produce uniform increments of swing weight. Continually greater cuts could be made on four additional standard shafts but this is not desirable because the additional shortening adversely affects the basic characteristics of the shaft.

For the second group, another four basic stock shafts of identical stiffness characteristics are provided, but these shafts have a stiffness classification of "stiff". With the full length tip end, these shafts are just slightly stiffer than the regular shaft with one inch cut from the tip end. Therefore, the first shaft of this group with no cut is connected to the No. 6 head, which again is enough heavier than the No. 5 head to give the desired increase in swing weight. The second, third, and fourth shafts are cut and attached in the same way as those in the first group.

When all of the clubs are assembled, the butt or grip ends are cut off the necessary amount to produce the usual finished length for each club, and the grips are mounted on these butt ends. As is well known, the total lengths of the clubs decrease by about one half inch from one number to the next higher number throughout the set. Since the grip ends are practically rigid the amount cut off of each one does not affect the flexibility of the shaft trimmed as described above.

The description above refers to a set of irons for the usual non-professional male golfer. The same basic system with numerical variations may be used to produce stiffer sets for professionals and softer or weaker sets for women.

BRIEF DESCRIPTION OF THE DRAWINGS

Various other advantages and features of novelty will become apparent as the description proceeds in conjunction with the accompanying drawings, in which.

DESCRIPTION OF PREFERRED EMBODIMENTS

Figure 1:
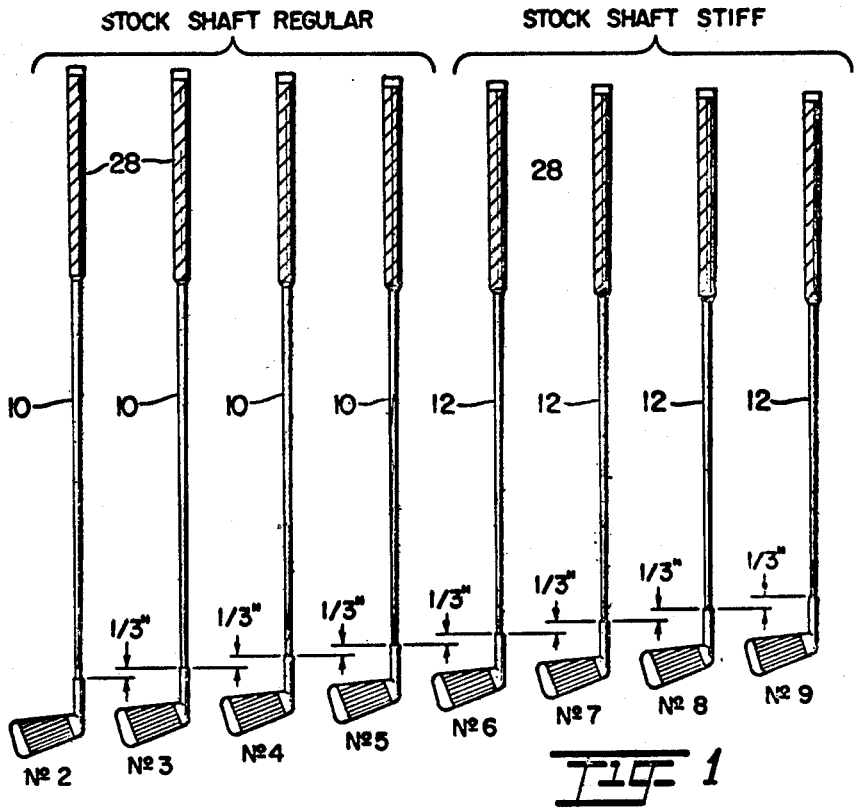
FIG. 1 is a schematic representation of a set of golf irons embodying the invention.
Figure 3:
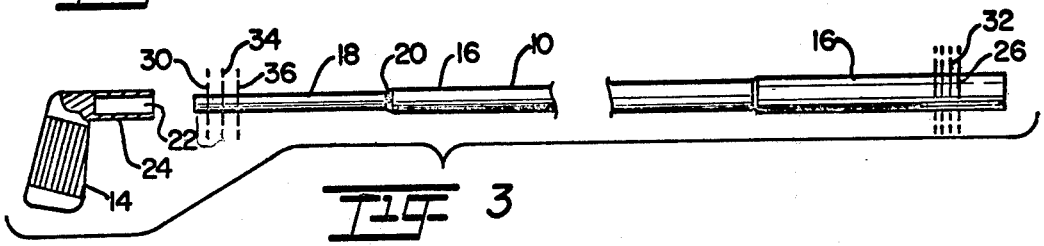
FIG. 3 is a schematic view of a basic stock shaft and typical club head.

The practice of the invention results, in an illustrative example, in a set of finished irons such as shown schematically in FIG. 1, and the process is carried out with a plurality of stock shafts and suitable heads such as shown schematically in FIG. 3. In the example, the clubs are numbered from 2 to 9, with the understanding that the system applies in the same basic way to No. 1 and to the pitching wedge and sand wedge. A basic stock shaft 10 having a stiffness classification of regular is used for clubs No. 2 to No. 5, and a basic stock shaft 12 having a stiffness classification of stiff is used for clubs No. 6 to No. 9. The shafts in each classification are identical with each other in all characteristics within normal manufacturing tolerances, the second group being stiffer than the first group. The heads 14 are generally similar in appearance but differ in loft angle and weight from the lowest to highest numbers.

Turning to FIG. 3, the basic stock shaft 10 may be continuously tapered from end to end, or tapered and necked down in several steps or a series of necked down cylindrical sections as shown. It is provided with a butt or grip end 16 which is rigid for practical purposes and is formed with initial excess length to allow for cutting off to produce a desired total length in a finished club. The flexibility increases as the diameter decreases and the tip end 18 is quite flexible compared to the grip end 16. The tip end has an initial predetermined length as measured from any suitable constant reference point such as the neck-down step 20, and ordinarily all shafts are used with full length tip ends for any club in a conventional set.

In normal practice, and in making up the first club of the exemplary set, the tip end 18 is inserted in socket 22 formed in the hosel or neck 24 of the club head. It is positively pinned in place and usually also cemented to prevent any looseness or separation. Head 14 in this case is a No. 2 with a certain predetermined weight. After the shaft and head are assembled, the grip end 16 is cut off at point 26 to produce the finished club length desired for this particular iron, and the grip 28 is secured in place.

The next identical stock shaft 10 is now prepared by cutting off the tip end at 30 to reduce its length, as measured from reference point 20, by a certain increment which in this case is one third of an inch. The foreshortened tip end is now inserted in a similar socket 22 of a second club head which is a No. 3 and is secured in place in the same fashion as the first shaft and head. It will be apparent that the foreshortening of the flexible tip end will reduce the flexibility of the modified shaft by a measurable increment. The No. 3 head is enough heavier than the preceding No. 2 head to increase the swing weight by the desired predetermined increment. The grip end 16 is cut off at point 32 to produce the desired total club length and a grip 28 is secured in place. Ordinarily the cutoff points on grip end 16 will vary as indicated since club lengths usually decrease about one half inch from one number to the next, but this depends on the views of the club designer. In any event the amount of waste length cut off of the grip end will not affect the flexibility of the club and has no bearing on the invention.

The third and fourth basic stock shafts are modified and assembled in the same way to heads No. 4 and No. 5, the cutoff points being at 34 and 36 respectively, and the appropriate waste lengths are cut off of grip end 16. Thus, the tip ends of the second, third, and fourth basic stock shafts are foreshortened with respect to the full tip end length by increasing increments of one third inch, so that tip end of the fourth shaft is shorter, measured from reference point 20, than the full length tip end by one inch. Heads No. 4 and No. 5 are each heavier than the preceding heads by a sufficient amount to increase the swing weight in uniform increments substantially equal to the increment between No. 2 and No. 3.

To complete the set, the second group of irons No. 6 to No. 9 are made up in exactly the same way as the first group but using the stiff stock shaft in place of the regular stock shaft. Therefore, the first shaft in the second group has a full length tip end. This shaft is stiffer than the standard shaft with a one inch cut by approximately the same increment as the variations between the several cut off lengths so that a substantially uniform decrease in flexibility is obtained from the lowest numbered iron to the highest in the set. Heads No. 6 to No. 9 increase in weight by enough to continue the substantially uniform increase in swing weight throughout the set.

Figure 2:
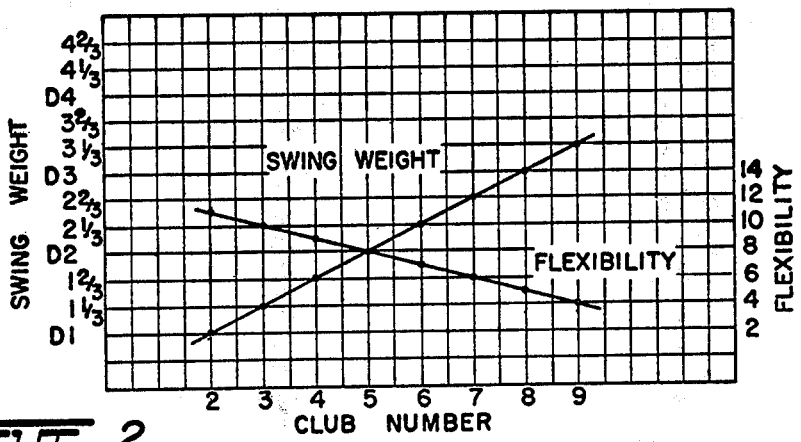
FIG. 2 is a chart schematically illustrating the relation between club number, flexibility, and swing weight.

The set described above is intended for use by the average male golfer, and it has been determined that a suitable swing weight for the No. 2 iron is D1, an arbitrary value which may be measured on the Adams scale, and that the swing weight should increase in increments of one third of a swing weight unit, so that iron No. 5 would have a value of D2 and iron No. 8 would have a value of D3, etc., as indicated in the chart of FIG. 2, which is directed to the set described above. The other line on the chart indicates the flexibility change. It will be seen that in the improved club set of the invention the lowest numbered club has the lowest swing weight and the greatest flexibility and that the swing weight gradually increases and the flexibility gradually decreases through the range to the highest numbered club. Therefore, in the long irons the golfer gets a lighter feel and greater flexibility which enables him to get the ball up and flying, which is more important then accuracy. Conversely, in the short irons he gets a heavier feel and less flexibility which slows down the swing and enables him to exercise greater control for the accuracy which is more important in the short shots.

The same principles may be applied if it is desired to make up a complete set of irons from No. 1 through the sand wedge. In such case, the No. 1 head would be assembled with a soft shaft with a one inch cutoff and the swing weight would be D 02/3 The pitching wedge would be assembled with a stiff shaft with a 1⅓ inch cutoff and the swing weight would be D 3⅔. The sand wedge would be assembled with a stiff shaft with a 1⅔ inch cutoff and the swing weight would be D 4. In the latter two cases it is permissible to cut off more than one inch because of the greater basic stiffness of the shafts.

A professional set of irons should be heavier and stiffer. It is made up in basically the same way, using different values. As an example, the No. 2 head would be assembled with a regular shaft with a ⅓ inch cutoff and the swing weight would be D 1 ⅔. The cutoff increments are ⅓ inch throughout and the swing weight increments are ⅓ unit throughout. The basic stock shaft changes from regular to stiff between the No. 4 iron and the No. 5 iron.

A weak or soft set, such as usually used by women, would also be made up in the same way, again with different values. As an example, the No. 2 head would be assembled with a regular shaft with no cutoff and the swing weight would be D 0 (zero). The No. 3 head would be assembled with a regular shaft with a one fourth inch cutoff and the swing weight would be D 0¼. Thus, in this series, the original swing weight is significantly lower and the increase increments are one fourth unit throughout. Also, the cutoff increments are one fourth inch throughout, and the basic stock shaft changes from regular to stiff between the No. 6 iron and the No. 7 iron.

Comparative tabulations of the three short sets described above are as follows:

PROFESSIONAL SERIES

| Iron No. | Shaft | Cut | Swing Weight |
|---|---|---|---|
| 2 | Regular | ⅓ | D 1⅔ |
| 3 | " | ⅔ | D 2 |
| 4 | " | 1 | D 2⅓ |
| 5 | Stiff | 0 | D 2⅔ |
| 6 | " | ⅓ | D 3 |
| 7 | " | ⅔ | D 3⅓ |
| 8 | " | 1 | D 3⅔ |
| 9 | " | 1⅓ | D 4 |
| | REGULAR SERIES | | |
| 2 | Regular | 0 | D 1 |
| 3 | " | ⅓ | D 1⅓ |
| 4 | " | ⅔ | D 1⅔ |
| 5 | " | 1 | D 2 |
| 6 | Stiff | 0 | D 2⅓ |
| 7 | " | ⅓ | D 2⅔ |
| 8 | " | ⅔ | D 3 |
| 9 | " | 1 | D 3⅓ |
| | WEAK SERIES | | |
| 2 | Regular | 0 | D O |
| 3 | " | ¼ | D 0¼ |
| 4 | " | ½ | D 0½ |
| 5 | " | ¾ | D 0¾ |
| 6 | " | 1 | D 1 |
| 7 | Stiff | 0 | D 1¼ |
| 8 | " | ¼ | D 1½ |
| 9 | " | ½ | D 1¾ |

A study of the above tabulations will show that the theory of the invention is carried out in the same way in each series so that, although the values differ, the characteristics are similar and the chart of FIG. 2 is illustrative of all of them. The values set forth are considered to be optimum for the various categories of golfers but it will be apparent that other series may be prepared for individual customers who prefer characteristics between or beyond these series by applying the same principles. Thus any golfer may determine by experimentation one of the middle distance irons which suits him best and will then find that the long and short irons of that series will yield superior results on his long and short shots.

I claim:

1. A matched and correlated set of successively numbered golf irons including at least the series from the No. 2 iron to the No. 9 iron in which the lowest numbered iron has a determinable swing weight, and in which each successively higher numbered iron has a greater swing weight than the preceding iron from the lowest to the highest numbered iron in the set.

2. A set of irons as claimed in claim 1; the increase in swing weight between successive irons being in substantially uniform increments.

3. A set of irons as claimed in claim 2; each increment being of the order of one third of a swing weight unit.

4. A set of irons as claimed in claim 2; each increment being of the order of one fourth of a swing weight unit.

5. A set of irons as claimed in claim 1; the set including the series from the No. 1 iron to the sand wedge.

6. A set of irons as claimed in claim 1; in which the shaft of the lowest numbered iron has the greatest flexibility, and the shaft of each successively higher numbered iron has less flexibility than the preceding iron throughout the set.

7. A set of irons as claimed in claim 6; the decrease in flexibility between successive irons being in substantially uniform increments.

8. A set of irons as claimed in claim 7; the increase in swing weight between successive irons being in substantially uniform increments.

9. A matched and correlated set of successively numbered golf irons, including at least the series from the No. 2 iron to the No. 9 iron, each having a head and a shaft, and each shaft having a grip end and a tip end for connection to its respective head; the set comprising a first group from the lowest numbered iron in the set to one of the middle distance irons and a second group from the next higher numbered middle distance iron to the highest numbered iron in the set; each shaft in the first group comprising a substantially identical basic stock shaft having selected substantially identical stiffness characteristics; each shaft in the second group comprising a substantially identical basic stock shaft having selected substantially identical stiffness characteristics of greater degree than the stock shafts of the first group; each of the shafts in both groups being so constructed that the grip end is substantially rigid and each successive shaft portion proceeding toward the tip end is less stiff than the preceding portion, with the tip end portion being the least stiff; the tip end of the shaft for each successively higher numbered iron in each group being foreshortened by a predetermined increment with respect to the tip end of the shaft for the preceding iron in its respective group.

10. A set of irons as claimed in claim 9; the increment of flexibility difference between the last shaft of the first group and the first shaft of the second group being substantially the same as the increments of flexibility difference within the groups.

11. A set of irons as claimed in claim 9; the basic stock shaft of the first group having a stock stiffness classification of regular, and the basic stock shaft of the second group having a stock stiffness classification of stiff.

12. A set of irons as claimed in claim 9; the first mentioned middle distance iron being the No. 4 iron.

13. A set of irons as claimed in claim 12; the increment of foreshortening being approximately one third inch.

14. A set of irons as claimed in claim 13; the swing weight increasing substantially uniformly from the lowest numbered iron to the highest numbered iron in increments of approximately one third of a swing weight unit.

15. A set of irons as claimed in claim 14; the swing weight classification of the No. 2 iron being D 1 ⅔.

16. A set of irons as claimed in claim 9; the first mentioned middle distance iron being the No. 5 iron.

17. A set of irons as claimed in claim 16; the increment of foreshortening being approximately one third inch.

18. A set of irons as claimed in claim 17; the swing weight increasing substantially uniformly from the lowest numbered iron to the highest numbered iron in increments of approximately one third of a swing weight unit.

19. A set of irons as claimed in claim 18; the swing weight classification of the No. 2 iron being D 1.

20. A set of irons as claimed in claim 9; the first mentioned middle distance iron being the No. 6 iron.

21. A set of irons as claimed in claim 20; the increment of foreshortening being approximately one quarter inch.

22. A set of irons as claimed in claim 21; the swing weight increasing substantially uniformly from the lowest numbered iron to the highest numbered iron in increments of approximately one quarter of a swing weight unit.

23. A set of irons as claimed in claim 22; the swing weight classification of the No. 2 iron being D zero.

24. A method for producing a matched and correlated set of successively numbered golf irons including at least the series from the No. 2 iron to the No. 9 iron wherein the clubs decrease in length and increase in loft angle from the lowest numbered iron to the highest numbered iron in the set which comprises the steps of:

a. selecting, for a first group of irons from the lowest numbered iron in the set to one of the middle distance irons, substantially identical basic stock shafts having a tip end and a grip end and further having preselected substantially identical stiffness characteristics;

b. selecting, for a second group of irons from the next higher numbered middle distance iron to the highest numbered iron in the set, substantially identical basic stock shafts having a tip end and a grip end and further having preselected substantially identical stiffness characteristics of greater degree than the stock shafts of the first group;

c. cutting off the tip end of the shaft for each successively higher numbered iron in each group by a predetermined uniform increment with respect to the tip end of the shaft for the preceding iron in its respective group, wherein the amount cut off is such that a substantially uniform decrease in flexibility is obtained from the lowest numbered to the highest numbered iron in the set;

d. providing a series of successively numbered heads from the lowest to the highest number in the set and making each successive higher numbered head heavier than the preceding head by an amount sufficient to increase the swing weight in substantially uniform increments from the lowest to the highest numbered iron in the set;

e. attaching the shaft of greatest length to the lowest numbered head;

f. attaching the shaft of next greatest length to the next higher numbered head;

g. repeating the procedure of steps (e) and (f) until all of the shafts have been attached to their respective heads, and h. removing a predetermined amount of material from the grip end of each shaft as necessary to attain the proper finished total length for each iron.

25. A method as claimed in claim 24 in which the full tip end length of the basic stock shaft is utilized for attachment to the lowest numbered head in each of said groups.

26. A method as claimed in claim 24 including in step (c) cutting off the tip end of the lowest numbered iron shaft of said first group.

27. A method for producing a matched and correlated set of successively numbered golf irons including at least the series from the No. 2 iron to the No. 9 iron wherein the clubs decrease in length and increase in loft angle from the lowest numbered iron to the highest numbered iron in the set which comprises the steps of:

a. providing a series of shafts decreasing substantially uniformly in length to attain the proper finished total length for each iron and the said shafts further having uniformly decreasing flexibility from the lowest to the highest numbered iron in the set;

b. providing a series of successively numbered heads from the lowest to the highest number in the set and making each successive higher numbered head heavier than the preceding head by an amount sufficient to increase the swing weight in substantially uniform increments from the lowest to the highest numbered iron in the set;

c. attaching the shaft of greatest length and flexibility to the lowest numbered head;

d. attaching the shaft of next lower flexibility and length to the next higher numbered head, and e. repeating the procedure of steps (c) and (d) until all of the shafts have been attached to their respective heads.

* * * * *